US011658384B1

(12) United States Patent
Kennett et al.

(10) Patent No.: US 11,658,384 B1
(45) Date of Patent: May 23, 2023

(54) ANTENNA APPARATUS MOUNTING SYSTEM

(71) Applicant: Space Exploration Technologies Corp., Hawthorne, CA (US)

(72) Inventors: Ryan Kennett, Manhattan Beach, CA (US); Anthony Sims, Manhattan Beach, CA (US)

(73) Assignee: Space Exploration Technologies Corp., Hawthorne, CA (US)

( * ) Notice: Subject to any disclaimer, the term of this patent is extended or adjusted under 35 U.S.C. 154(b) by 0 days.

(21) Appl. No.: 17/065,707

(22) Filed: Oct. 8, 2020

Related U.S. Application Data

(60) Provisional application No. 62/959,148, filed on Jan. 9, 2020.

(51) Int. Cl.
*H01Q 1/12* (2006.01)

(52) U.S. Cl.
CPC ..... *H01Q 1/1242* (2013.01); *H01Q 1/1264* (2013.01)

(58) Field of Classification Search
CPC ..... H01Q 1/1242; H01Q 1/1264; H01Q 3/08; H01Q 1/2291; H01Q 1/42; H01Q 1/02; H01Q 1/1207; H01Q 1/1228; H01Q 1/125; H01Q 1/2283; H01Q 1/38; H01Q 1/422; H01Q 1/428; H01Q 15/144; H01Q 21/00; H01Q 21/065; H01Q 21/10; H01Q 23/00; H01Q 3/04; H01Q 9/0407; H01Q 9/0414; H01Q 5/10; H01Q 5/307; H01Q 3/36; H01Q 3/40; H01Q 21/061; H01Q 3/26; H01Q 21/20; H01Q 21/24; H01Q 1/24; H01Q 3/2658; H01Q 3/267; H01Q 3/28; H01Q 3/34; H01Q 5/42; H01Q 1/36; H01Q 15/14; H01Q 21/0018; H01Q 21/0025; H01Q 21/22; H01Q 1/28; H01Q 15/02; H01Q 3/24; H01Q 3/30; H01Q 1/22; H01Q 1/521; H01Q 1/523; H01Q 1/526; H01Q 15/002; H01Q 15/0053; H01Q 15/08; H01Q 19/062; H01Q 19/10; H01Q 19/106; H01Q 5/50; H01Q 9/0428; H01Q 21/0006; H01Q 21/0075; H01Q 9/26; H01Q 1/246; H01Q 1/12; H01Q 3/02; H01Q 21/28; H01Q 3/06; H01Q 1/18; H01Q 1/1257; H01Q 1/1235; H01Q 19/13; H01Q 1/3275; H01Q 3/005;
(Continued)

(56) References Cited

U.S. PATENT DOCUMENTS 5,769,104 A * 6/1998 Uemura ..... F16B 7/1427 135/69
6,682,029 B1 * 1/2004 Dierkes ..... F16M 11/14 248/165

(Continued)

FOREIGN PATENT DOCUMENTS

WO WO-2014124471 A1 * 8/2014 ..... A61B 90/50

*Primary Examiner* — Ab Salam Alkassim, Jr.
(74) *Attorney, Agent, or Firm* — Polsinelli PC

(57) ABSTRACT

An antenna apparatus having a housing enclosing antenna components and a leg extending from the housing includes a base securable to a surface and configured to receive a bottom portion of the leg. A locking assembly defined at the bottom portion of the leg is moveable between a first position, wherein the leg is removable from the base, and a second position, wherein the leg is lockingly secured within the base.

16 Claims, 7 Drawing Sheets

(58) Field of Classification Search

CPC ..... H01Q 1/34; H01Q 1/44; H01Q 1/084; H01Q 1/1221; H01Q 15/16; H01Q 19/12; H01Q 19/19; H01Q 19/132; H01Q 21/205; H01Q 3/18; H01Q 1/288; H01Q 1/08; H01Q 1/32; H01Q 3/14; H01Q 5/45; H01Q 19/104; H01Q 1/005; H01Q 3/20; H01Q 1/27; H01Q 3/00; H01Q 25/00; H01Q 1/50; H01Q 19/17; H01Q 21/30; H01Q 25/007; H01Q 21/08; H01Q 13/02; H01Q 1/3216; H01Q 1/247; H01Q 1/52; H01Q 21/064; H01Q 3/32; H01Q 1/40; H01Q 21/06; H01Q 1/3233; H01Q 9/32; H01Q 1/06; H01Q 1/088; H01Q 1/362; H01Q 1/20; H01Q 21/0087; H01Q 21/062; H01Q 9/16; H01Q 1/48; H01Q 1/273; H01Q 9/28; H01Q 1/10; H01Q 15/141; H01Q 11/08; H01Q 5/40; H01Q 1/185; H01Q 9/30; H01Q 13/0258; H01Q 1/243; H01Q 9/0464; H01Q 19/191; H01Q 3/16; H01Q 19/193; H01Q 19/30; H01Q 1/3225; H01Q 17/008; H01Q 19/18; H01Q 1/2216; H01Q 19/192; H01Q 1/242; H01Q 1/405; H01Q 1/241; H01Q 15/162; H01Q 3/12; H01Q 15/0013; H01Q 21/26; H01Q 21/29; H01Q 3/10; H01Q 13/08; H01Q 7/00; H01Q 13/00; H01Q 15/142; H01Q 21/0043; H01Q 1/525; H01Q 5/00; H01Q 5/20; H01Q 9/34; H01Q 1/00; H01Q 1/3283; H01Q 13/0208; H01Q 19/00; H01Q 3/2605; H01Q 5/328; H01Q 1/225; H01Q 1/282; H01Q 1/1214; H01Q 1/281; H01Q 13/10; H01Q 19/134; H01Q 3/01; H01Q 9/0421; H01Q 1/528; H01Q 7/08; H01Q 9/42; H01Q 1/081; H01Q 1/103; H01Q 1/325; H01Q 15/168; H01Q 15/18; H01Q 17/001; H01Q 19/04; H01Q 1/14; H01Q 3/245; H01Q 3/22; H01Q 1/427; H01Q 19/185; H01Q 21/245; H01Q 5/35; H01Q 1/2275; H01Q 19/06; H01Q 1/2208; H01Q 13/0241; H01Q 13/18; H01Q 13/24; H01Q 15/244; H01Q 15/246; H01Q 19/08; H01Q 5/28; H01Q 9/18; H01Q 1/421; H01Q 11/083; H01Q 15/163; H01Q 15/165; H01Q 3/46; H01Q 1/007; H01Q 1/04; H01Q 1/085; H01Q 5/357; H01Q 5/378; H01Q 1/002; H01Q 1/244; H01Q 1/245; H01Q 1/46; H01Q 19/02; H01Q 19/175; H01Q 21/005; H01Q 25/001; H01Q 5/30; H01Q 1/3208; H01Q 11/02; H01Q 13/065; H01Q 15/0086; H01Q 21/0056; H01Q 21/293; H01Q 25/008; H01Q 3/2652; H01Q 3/385; H01Q 5/15; H01Q 9/285; H01Q 13/06; H01Q 25/005; H01Q 3/2611; H01Q 5/335; H01Q 9/0485; H01Q 1/087; H01Q 13/0283; H01Q 21/0081; H01Q 3/2664; H01Q 1/2266; H01Q 13/085; H01Q 13/12; H01Q 5/22; H01Q 9/27; H01Q 1/082; H01Q 1/3266; H01Q 11/10; H01Q 21/0012; H01Q 21/067; H01Q 25/002; H01Q 3/2617; H01Q 3/2635; H01Q 9/40; H01Q 1/2225; H01Q 1/2258; H01Q 1/30; H01Q 1/3291; H01Q 19/028; H01Q 19/15; H01Q 25/02; H01Q 5/55; H01Q 1/1271; H01Q 21/0093; H01Q 5/314; H01Q 9/045; H01Q 9/0457; H01Q 9/44; H01Q 11/04; H01Q 13/103; H01Q 15/0033; H01Q 15/20; H01Q 15/22; H01Q 15/24; H01Q 17/00; H01Q 19/108; H01Q 19/195; H01Q 21/0031; H01Q 25/04; H01Q 3/44; H01Q 9/20; H01Q 9/36; H01Q 1/1285; H01Q 1/16; H01Q 1/2233; H01Q 1/248; H01Q 13/0225; H01Q 13/0275; H01Q 13/20; H01Q 13/22; H01Q 15/0006; H01Q 15/161; H01Q 15/23; H01Q 19/28; H01Q 3/38; H01Q 5/25; H01Q 9/06; H01Q 9/14; H01Q 11/086; H01Q 15/147; H01Q 19/023; H01Q 3/242; H01Q 3/247; H01Q 5/385; H01Q 9/0471; H01Q 9/0478

See application file for complete search history.

(56) References Cited

U.S. PATENT DOCUMENTS

| | | | | |
|---|---|---|---|---|
| 7,525,507 | B1 * | 4/2009 | Henry, Jr. | H01Q 1/125 343/882 |
| 2004/0047682 | A1 * | 3/2004 | Ståhle et al. | F16B 7/149 403/377 |
| 2004/0108423 | A1 * | 6/2004 | Boaro | A47B 96/1425 248/161 |
| 2004/0169114 | A1 * | 9/2004 | Dierkes | H01Q 1/125 248/165 |
| 2007/0228215 | A1 * | 10/2007 | Hudson | B64D 11/0696 244/118.1 |
| 2008/0247746 | A1 * | 10/2008 | Law | F16M 11/041 396/419 |
| 2008/0278399 | A1 * | 11/2008 | Nakajima | H01Q 1/42 343/878 |
| 2010/0073257 | A1 * | 3/2010 | Sherwood | H01Q 3/08 343/882 |
| 2010/0284737 | A1 * | 11/2010 | McPheeters | E04D 13/00 52/173.1 |
| 2013/0284864 | A1 * | 10/2013 | Vandegrift | F16M 11/18 254/387 |
| 2015/0194722 | A1 * | 7/2015 | Chinn | H01Q 1/088 248/523 |
| 2016/0268669 | A1 * | 9/2016 | Wilcox | F16M 11/18 |
| 2018/0159201 | A1 * | 6/2018 | Woodling | H01Q 3/04 |
| 2019/0339037 | A1 * | 11/2019 | Burton | F41A 23/06 |
| 2021/0265764 | A1 * | 8/2021 | Hachadorian | H01R 13/5213 |

* cited by examiner

ANTENNA APPARATUS MOUNTING SYSTEM

CROSS-REFERENCE TO RELATED APPLICATION

This application claims the benefit of U.S. Provisional Application No. 62/959,148, filed Jan. 9, 2020, the disclosure of which is hereby expressly incorporated by reference herein in its entirety.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In one aspect, a mounting system for an antenna apparatus having a housing enclosing antenna components and a leg extending from the housing includes a base securable to a surface and configured to receive a bottom portion of the leg and a locking assembly defined at the bottom portion of the leg and moveable between a first position, wherein the leg is removable from the base, and a second position, wherein the leg is lockingly secured within the base.

In another aspect, an antenna apparatus includes a housing enclosing antenna components, a leg extending from the housing, a base securable to a surface and configured to receive a bottom portion of the leg, and a locking assembly defined at the bottom portion of the leg and moveable between a first position, wherein the leg is removable from the base, and a second position, wherein the leg is lockingly secured within the base.

In another aspect, a method of mounting an antenna apparatus to a surface, wherein the antenna apparatus includes a housing enclosing antenna components and a leg extending from the housing, includes securing a base to a surface, disposing a bottom portion of the leg in the base, moving a locking assembly from a first position, wherein the leg is removable from the base, into a second position, wherein the leg is lockingly secured within the base.

DESCRIPTION OF THE DRAWINGS

The foregoing aspects and many of the attendant advantages of this disclosure will become more readily appreciated as the same become better understood by reference to the following detailed description, when taken in conjunction with the accompanying drawings, wherein.

DETAILED DESCRIPTION

Figure 1:
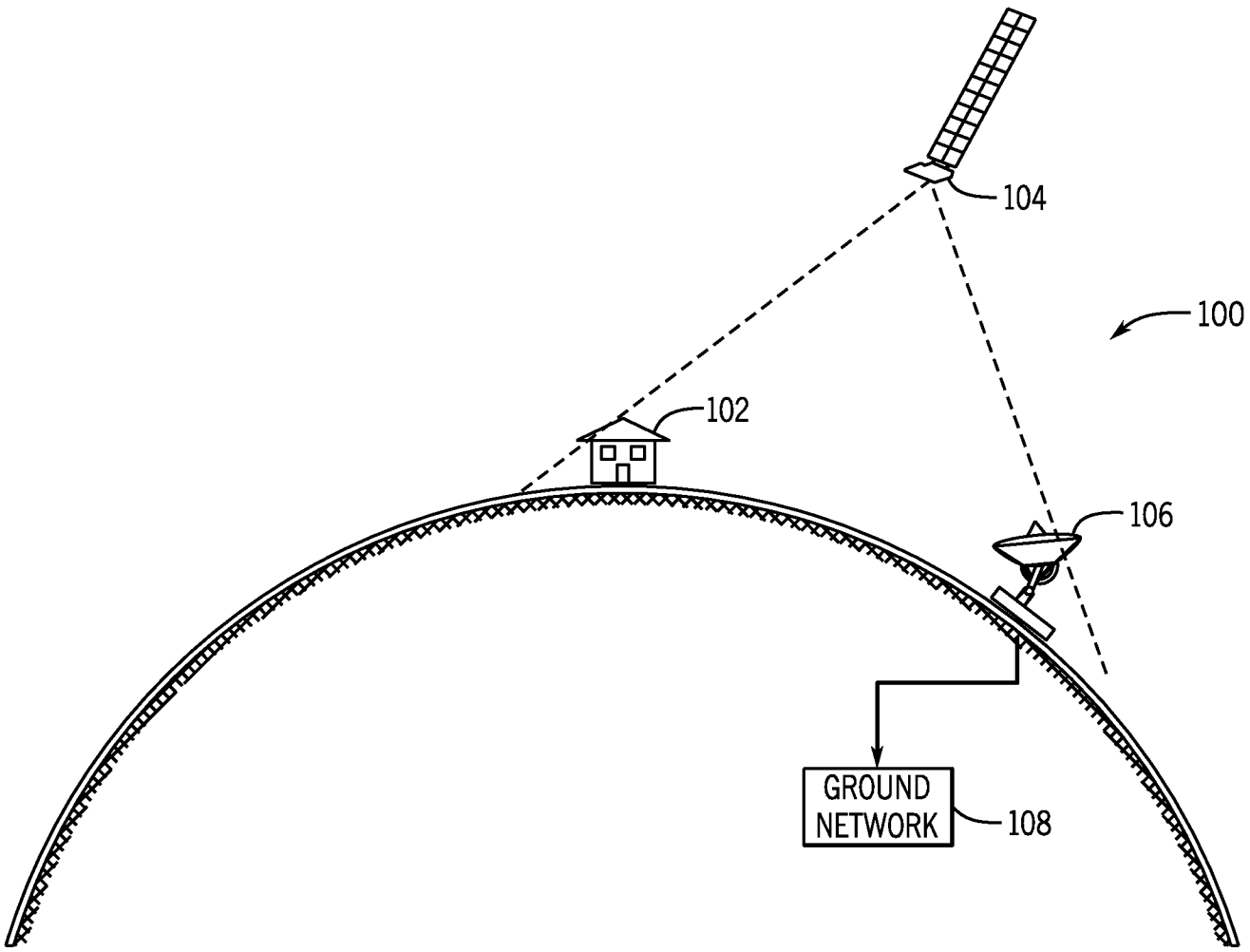
FIG. 1 is a not-to-scale diagram illustrating a simple example of communication in a satellite communication system.

Systems are currently being deployed to provide high-bandwidth, low-latency network communication via constellations of satellites in low Earth orbit (LEO). FIG. 1 is a not-to-scale schematic diagram that illustrates a simple example of communication in such a system 100. An endpoint terminal 102 is installed at a house, a business, a vehicle, or another location where it is desired to obtain communication access via a network of satellites. A communication path is established between the endpoint terminal 102 and a first satellite 104. In the illustrated embodiment, the first satellite 104, in turn, establishes a communication path with a gateway terminal 106. In another embodiment, the first satellite 104 may establish a communication path with another satellite prior to communication with a gateway terminal 106. The gateway terminal 106 is physically connected via fiber optic, Ethernet, or another physical connection to a ground network 108. The ground network 108 may be any type of network, including the Internet.

Embodiments of the present disclosure are directed to configurations for endpoint terminals 102 (or user terminals) used for network communications to and from a satellite. In particular, the exemplary embodiments of the present disclosure are directed to an antenna apparatus 200 including an antenna system designed for sending and/or receiving radio frequency signals to and/or from a satellite or a constellation of satellites.

Figure 2:
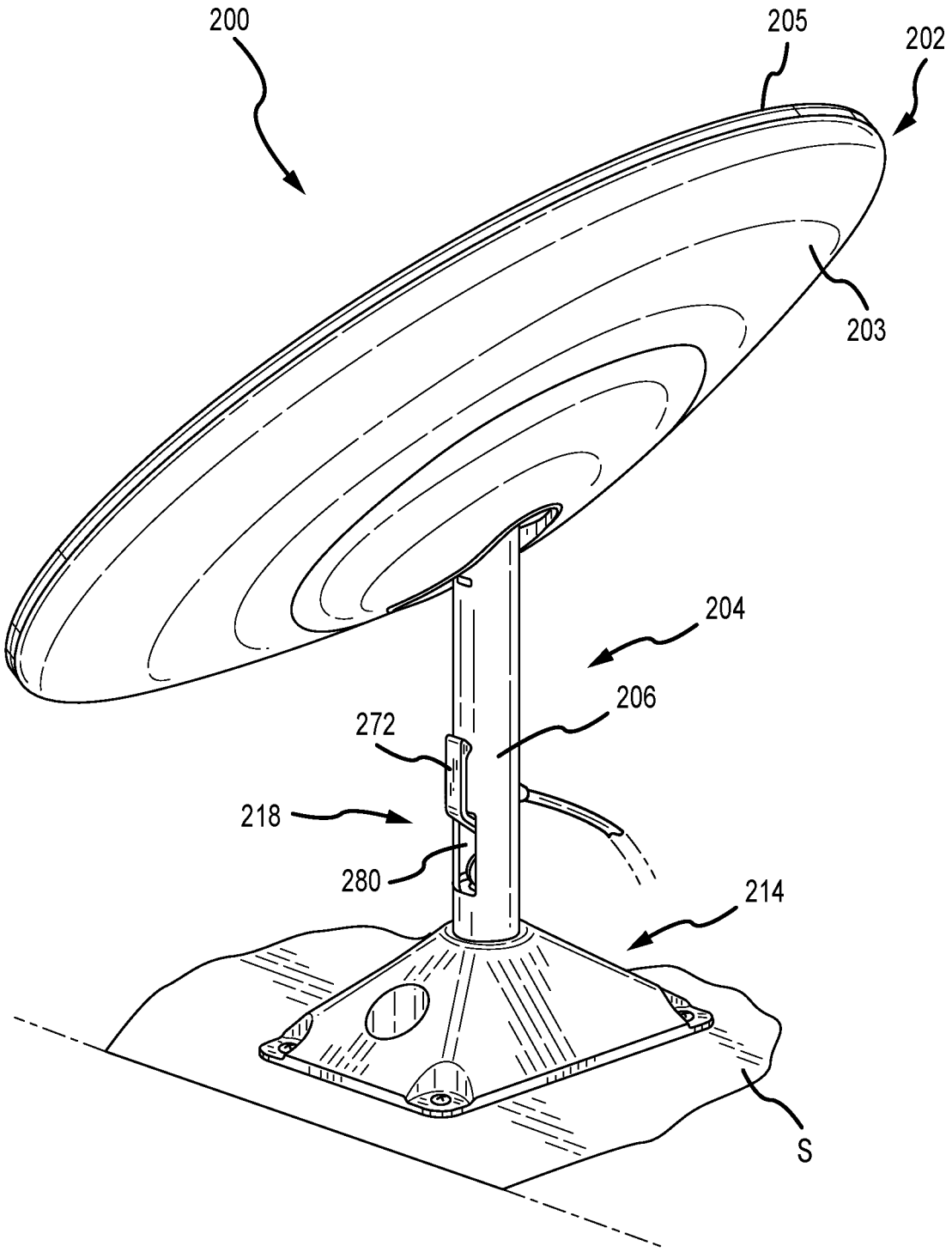
FIG. 2 is an isometric view of an antenna apparatus shown mounted to a surface with a mounting system.
Figure 3:
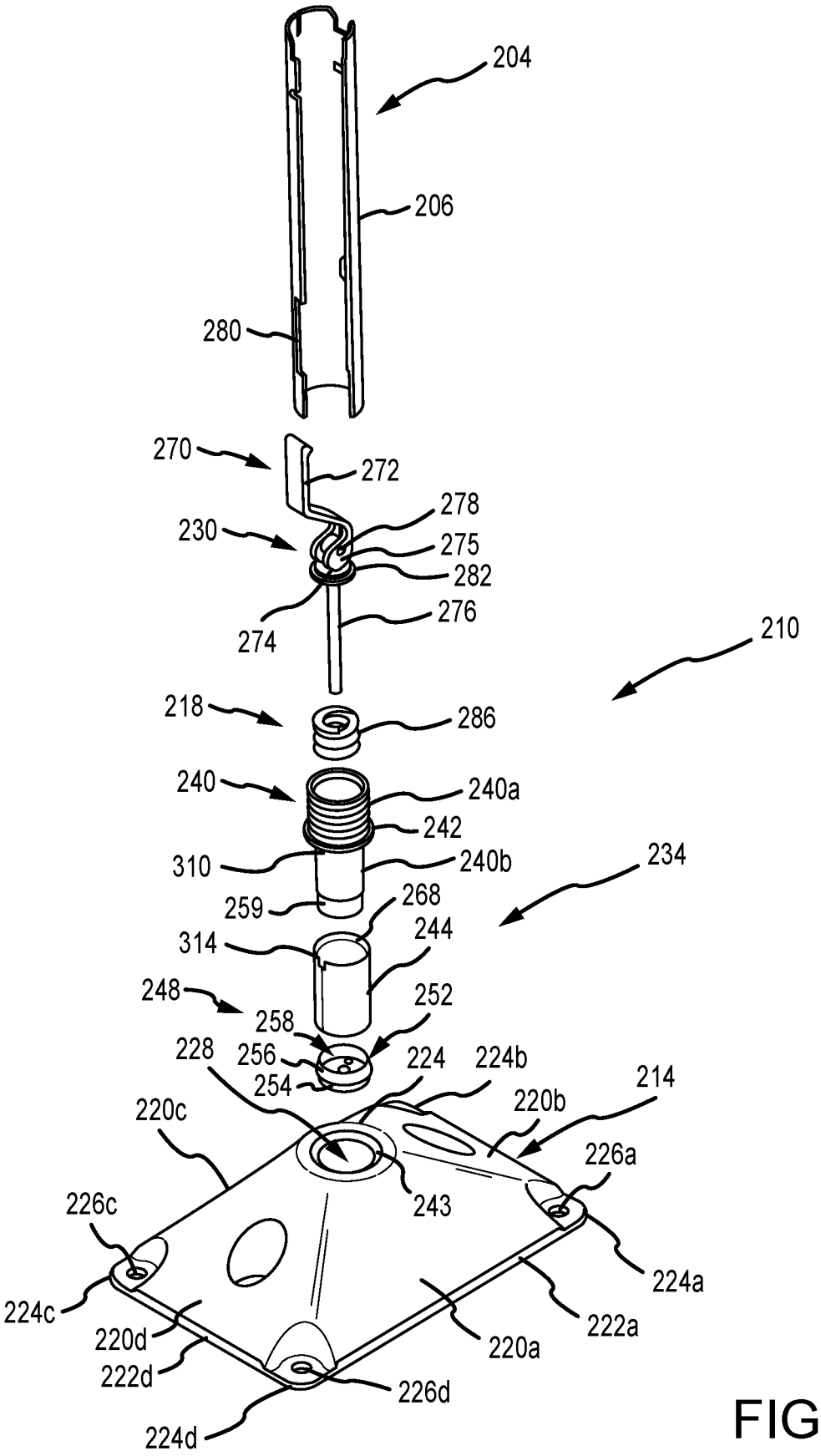
FIG. 3 is a top isometric exploded view of the mounting system of FIG. 2.
Figure 4:
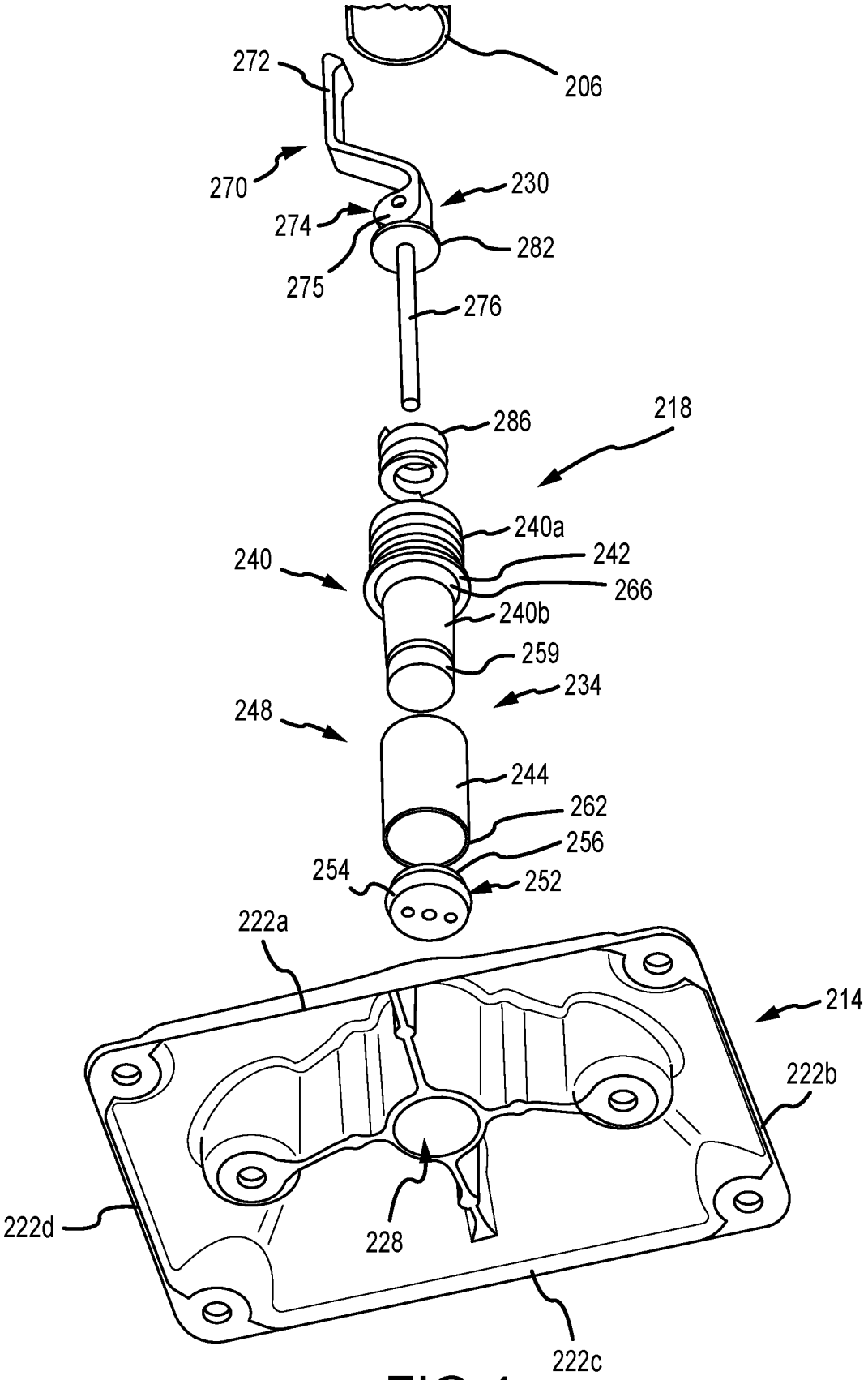
FIG. 4 is a bottom isometric exploded view of the mounting system of FIG. 2.

Referring to FIG. 2, the antenna apparatus 200 includes a housing 202, within which an antenna aperture (not shown) and other electronic components are disposed. In accordance with embodiments of the present disclosure, the antenna apparatus 200 and its housing 202 are designed for durability and reliability in an outdoor environment.

In the illustrated embodiment, the antenna apparatus 200 includes a single leg 204 extending from the housing 202. The leg 204 may be defined by a generally hollow cylindrical or tubular body 206, although other configurations may be used. With a hollow configuration, any necessary wiring or electrical connections may extend into and within the interior of the body 206 of the leg 204 up into the housing 202 of the antenna apparatus 200.

The leg 204 may extend from the housing 202 at substantially a center point of the housing 202. The center mount location allows for symmetry and balance when the antenna apparatus 200 is mounted to a surface. However, in other embodiments, the leg 204 may be attached to the housing 202 at an offset location depending on the configuration and weighting of the antenna apparatus 200. Moreover, in other embodiments, more than one leg may extend from the housing 202.

The lower end of the leg 204 is mountable to a mounting surface S to position the antenna apparatus 200 for an unimpeded view of the sky. As non-limiting examples, the antenna apparatus 200 may be mounted on the roof or wall of a building, a tower, a natural structure, a ground surface, or to any other appropriate mounting surface having unimpeded communication with the sky. After the antenna apparatus 200 is mounted on an external surface of a building, moreover, any cabling can be connected to an outlet external to the building or it can be routed through an opening into an outlet internal to the building.

The lower end of the leg 204 is mountable to a mounting surface S via a mounting system 210. In general, the mounting system 210 includes a base 214 securable to a surface S and configured to receive a bottom portion of the leg 204, and a locking assembly 218 defined at the bottom portion of the leg 204 and moveable between a first position, wherein the leg 204 is removable from the base 214, and a second position, wherein the leg 204 is lockingly secured within the base 214.

Referring to FIGS. 3-6, an exemplary embodiment of the mounting system 210 will now be described in greater detail. As noted above, the mounting system 210 includes a base 214 securable to a surface and configured to receive a bottom portion of the leg 204. As may best be seen by referring specifically to FIGS. 3 and 4, the base 214 is a suitable shape, size, and configuration to be secured to a mounting surface and to provide stability for the antenna apparatus 200 when mounted to the surface through the base 214.

Although the base 214 may be any suitable configuration, in the illustrated embodiment, the base 214 is of a generally truncated pyramidal shape having first, second, third, and fourth sides 220*a*, 220*b*, 220*c*, and 220*d* extending upwardly from corresponding bottom edges 222*a*, 222*b*, 222*c*, and 222*d*. First, second, third, and fourth corners 224*a*, 224*b*, 224*c*, and 224*d* are defined between respective bottom edges 222*a*/222*b*, 222*b*/222*c*, 222*c*/222*d*, and 222*d*/222*a*. At least one, and preferably first, second, third, and fourth mounting holes 226*a*, 226*b*, 226*c*, and 226*d* are defined at each respective corner 224*a*, 224*b*, 224*c*, and 224*d* of the base 214 and are configured for receiving a fastener, such as a bolt, for mounting the base 214 to a surface. A cavity (not labeled) may be defined at each corner for providing better access to the mounting hole. Additional holes and receptacles may extend through the base to accommodate any wiring coming from a building, etc.

Figure 6:
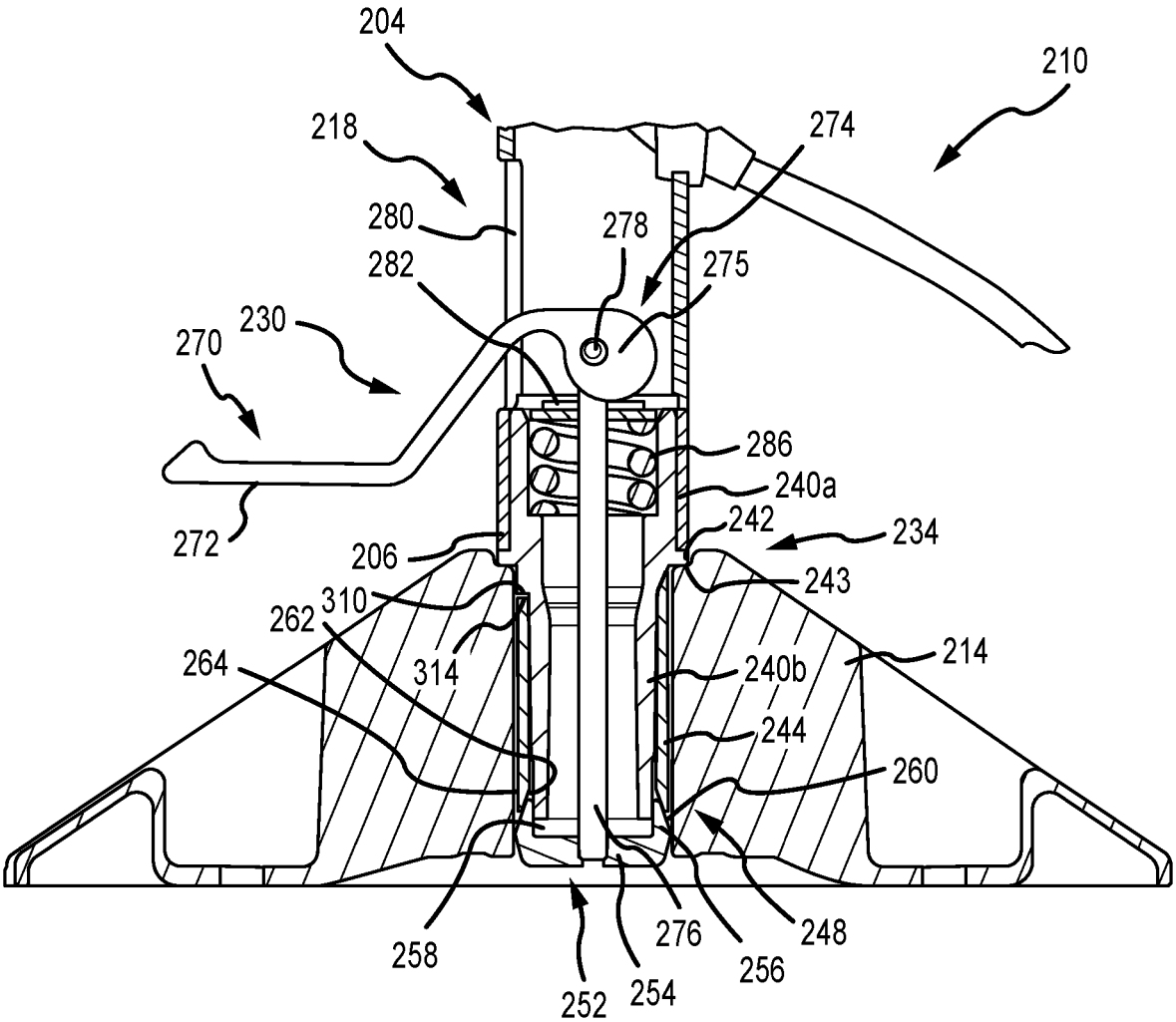
FIG. 6 is a cross-sectional view of the mounting system of FIG. 2 shown in an unlocked configuration.
Figure 7:
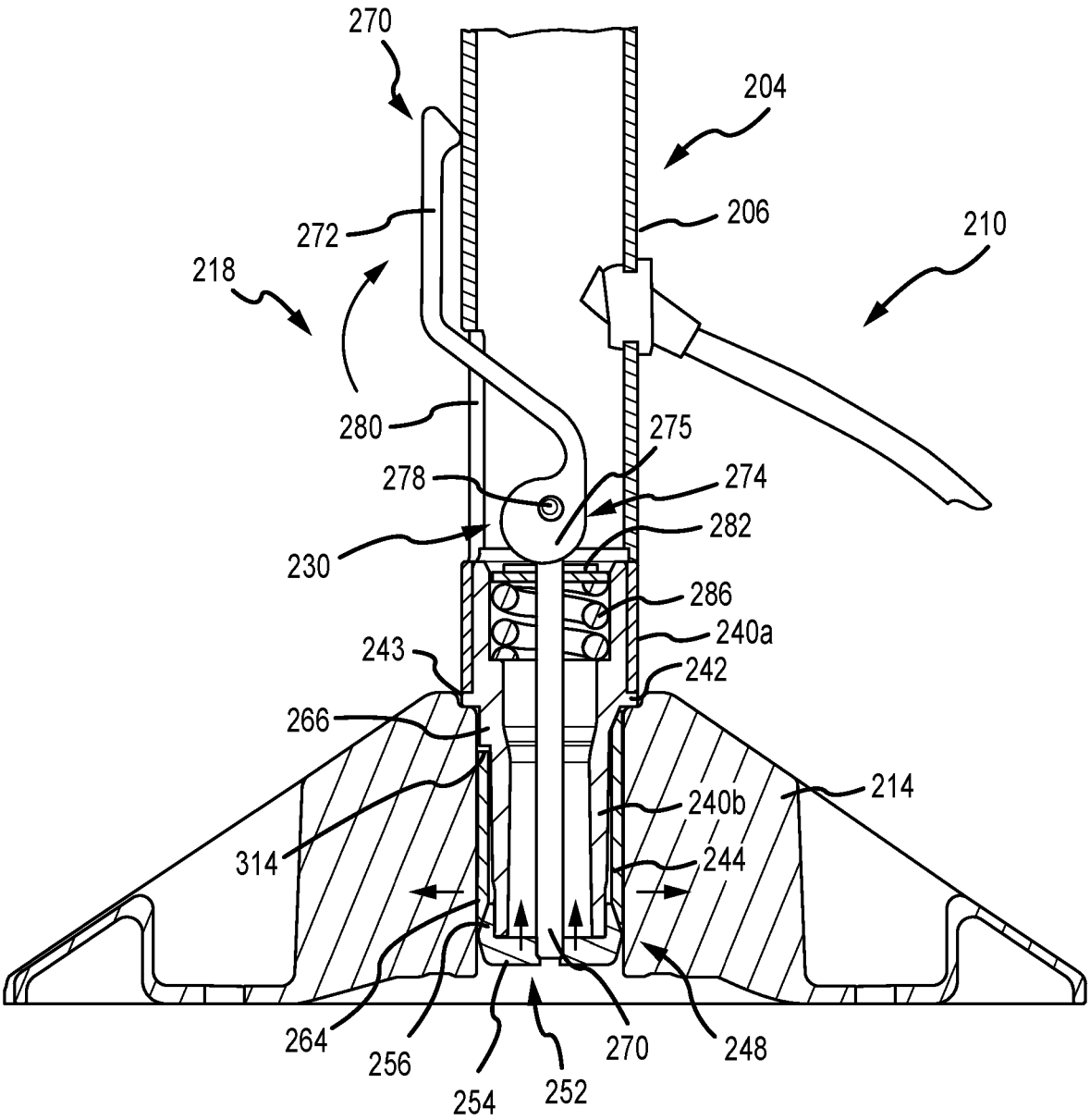
FIG. 7 is a cross-sectional view of the mounting system of FIG. 2 shown in a locked configuration.

The sides 222*a*-222*d* terminate at their upper edges in a truncated vertex 224. The truncated vertex 224 defines the top opening of a substantially centered leg receptacle 228 extending along a height of an interior of the base 214, as shown in FIGS. 6-7. The leg receptacle 228 is configured to receive a portion of the locking assembly 218 extending from the leg 204. In that regard, in some aspects, the locking assembly 218 can be understood to be an extension of a bottom portion of the body 206 of the leg 204.

Referring specifically to FIGS. 3-7, the locking assembly 218 defined at the bottom portion of the leg 204 and configured to lockingly secure the leg 204 within or to the base 214 will now be described. In general, the locking assembly 218 includes a cam assembly 230 configured to interface with an interference assembly 234 for moving the interference assembly 234 between a first, unlocked position (see FIG. 6), wherein the leg 204 may be moved into and out of the leg receptacle 228, and a second locked position, wherein the leg 204 is lockingly secured within the leg receptacle 228 (see FIG. 7).

In one embodiment, the interference assembly 234 is generally configured as a cylindrical extension of the body 206 at the bottom of the leg 204 that is configured to expand, at least in part, when received within the leg receptacle 228 to define an interference or press fit between the leg 204 and the interior of the base 214. In the depicted exemplary embodiment, the interference assembly may be defined by a first hollow cylinder 240 having an upper cylinder portion 240*a* configured to be secured within the bottom interior of the leg body 206 (such as by threading), and a lower cylinder portion 240*b* configured to extend within the leg receptacle 228 of the base 214. In that regard, the lower cylinder portion 240*b* has a first outer diameter less than the inner diameter of the leg receptacle 228 such that the lower cylinder portion 240*b* may be received within the leg receptacle 228. Moreover, the lower cylinder portion 240*b* has a length extending along a majority of the height of the base 214 when received within the leg receptacle 228.

An annular shoulder 242 may separate the upper and lower cylinder portions 240*a* and 240*b* and may be receivable within a correspondingly-shaped receptacle or bore 243 defined at the upper end of the base 214 surrounding the leg receptacle 228. In this manner, the annular shoulder 242 may rest against an interior shoulder defined by the bore 243 to appropriately locate the lower cylinder portion 240*b* within the leg receptacle 228 when initially inserted. The annular shoulder 242 also provides a hard stop against which the lower end of the leg 204 may abut when the upper cylinder portion 240*a* is received therein.

The interference assembly 234 further includes a second hollow cylinder 244 coaxially located (i.e., nested) on the lower cylinder portion 240*b* of the first hollow cylinder 240. In that regard, the second hollow cylinder 244 has an inner diameter at least slightly greater than the outer diameter of the lower cylinder portion 240*b* of the first hollow cylinder 240, and a length similar to the lower cylinder portion 240*b* of the first hollow cylinder 240. Moreover, the second hollow cylinder 244 has an outer diameter at least slightly less than the inner diameter of the leg receptacle 228. In this manner, the second hollow cylinder 244, while nested on the lower cylinder portion 240*b* of the first hollow cylinder 240, may be received within the leg receptacle 228 of the base 214. In that regard, when received within the leg receptacle 228 of the base 214, the second hollow cylinder 244 is circumferentially disposed between the lower cylinder portion 240*b* and the base 214.

The second hollow cylinder 244 has an axial length substantially similar to the lower cylinder portion 240*b*. In that regard, the second hollow cylinder 244 is coaxially disposed on the lower cylinder portion 240*b* such that it extends between the annular shoulder 242 and a bottom end of the lower cylinder portion 240*b*. The second hollow cylinder 244 is retained in its axial position on the lower cylinder portion 240*b* by the annular shoulder 242 and a cap 252 moveable secured to the bottom end of the lower cylinder portion 240*b* (described in more detail below).

The second hollow cylinder 244 is configured to radially expand when the interference assembly 234 is moved into the locking position. More particularly, the second hollow cylinder 244 moves between a first, unexpanded radial configuration when the interference assembly 234 is in the first, unlocked position (see FIG. 6), and a second, expanded radial configuration when the interference assembly 234 is in the second, locked position (see FIG. 7). In the second, expanded radial configuration, the outer diameter of the second hollow cylinder 244 is increased (compared to the first, unexpanded radial configuration) to define an interference or press fit between the second hollow cylinder 244 and the base 214.

The second hollow cylinder 244 may be made from a suitably deformable material to support its radial expansion. Moreover, in some embodiments, an elongated slot may extend along the length of the second hollow cylinder 244 to facilitate radial expansion of the second hollow cylinder 244, like a split ring. Further, in some embodiments, the second hollow cylinder 244 may have a high friction outer surface, such as a knurled outer surface (not shown), to increase the locking interface between the second hollow cylinder 244 and the base 214 when expanded.

The second hollow cylinder 244 may be moved between the first, unexpanded radial configuration and the second, expanded radial configuration through a suitable wedge assembly 248. The wedge assembly 248 is generally configured to apply an interior radial expansion force against the cylindrical wall of the second hollow cylinder 244 to radially expand the second hollow cylinder 244. With the second hollow cylinder 244 radially expanded, the interference assembly 234 securely locks the leg 204 within the base 214.

In the depicted exemplary embodiment, the wedge assembly 248 is defined in part by a cap 252 that is configured to be wedged between the nested bottom ends of the second hollow cylinder 244 and the lower cylinder portion 240*b* of the first hollow cylinder 240. The cap 252 has an overall cylindrical shape defined by a circular base 254 and an annular rim 256 extending upwardly from a perimeter of the base 254. The circular base 254 and the annular rim 256 collectively define a cylindrical cap receptacle 258 configured to receive the bottom end of the lower cylinder portion 240*b* when the cap 252 is moved upwardly into engagement with the lower cylinder portion 240*b*.

When the cap 252 is engaged with the lower cylinder portion 240*b*, the annular rim 256 of the cap 252 extends between the exterior surface of the lower cylinder portion 240*b* and the interior of the second hollow cylinder 244. More specifically, the annular rim 256 is configured to be wedged between the nested bottom ends of the second hollow cylinder 244 and the lower cylinder portion 240*b*. When wedged between the nested bottom ends of the second hollow cylinder 244 and the lower cylinder portion 240*b*, the annular rim 256 imposes a radial expansion force on the second hollow cylinder 244.

To help facilitate the radial expansion of the second hollow cylinder 244 at the wedged interface, the annular rim 256 includes an exterior ramp surface 260 that tapers inwardly (toward the center of the cap 252) as it extends from the base 254. With the exterior surface of the annular rim 256 tapered inwardly in this manner, the annular rim 256 has an overall annular wedge shape that can slide into wedged engagement between the nested bottom ends of the second hollow cylinder 244 and the lower cylinder portion 240*b*. To that end, the annular rim 256 may be hereinafter referred to as the first annular wedge 256 having an exterior ramp surface 260.

The exterior ramp surface 260 of the first annular wedge 256 is moveable into mating, sliding engagement with a correspondingly-shaped interior ramp surface 262 of a second annular wedge 264 defined at the lower end of the second hollow cylinder 244. As the cap 252 is moved upwardly into engagement with the nested bottom ends of the second hollow cylinder 244 and the lower cylinder portion 240*b*, the exterior ramp surface 260 of the cap 252 slides along the interior ramp surface 262 of the second hollow cylinder 244. The interface of the exterior and interior ramp surfaces 260 and 262 facilitates sliding, axial movement of the cap 252 relative to the second hollow cylinder 244.

Moreover, as the cap 252 is moved into wedged engagement with the nested second hollow cylinder 244/lower cylinder portion 240*b*, the first annular wedge 256 exerts an outward radial expansion force on the second hollow cylinder 244 to radially expand the second hollow cylinder 244. The lower cylinder portion 240*b* may be configured to react any inward radial force imposed by the annular rim 256 as it moves into wedged engagement with the nested second hollow cylinder 244/lower cylinder portion 240*b*. In a radially expanded state, the second hollow cylinder 244 is press fit within the base 214 to secure the leg 204 within the leg receptacle 228.

It can be appreciated that when the first annular wedge 256 is moved upwardly into engagement with the nested bottom ends of the second hollow cylinder 244 and the lower cylinder portion 240*b*, the cap 252 imposes a majority of the radial expansion force at the bottom of the second hollow cylinder 244. In that regard, a suitable interface may be defined at the upper ends of the nested second hollow cylinder 244/lower cylinder portion 240*b* to support radial expansion of the second hollow cylinder 244. For instance, the lower cylinder portion 240*b* of the first hollow cylinder 240 may include an exterior, radially expanding third annular wedge 266 extending around it upper perimeter (just below the annular shoulder 242).

An exterior ramp surface (not labeled) of the third annular wedge 266 is slidably mateable with a correspondingly-shaped interior ramp surface (not labeled) of a fourth annular wedge 268 defined at the upper end of the second hollow cylinder 244. When mated (i.e., nested), the fourth annular wedge 268 of the second hollow cylinder 244 may slide against the third annular wedge 266 of the lower cylinder portion 240*b*. In the least, the ramped interface between the upper ends of the second hollow cylinder 244 and the lower cylinder portion 240*b* may help reduce any mechanical stresses on the upper end of the second hollow cylinder 244 during radial expansion.

The cap 252 is pulled axially upwardly into wedged, mating engagement with the nested second hollow cylinder 244/lower cylinder portion 240*b* through the cam assembly 230. In the depicted exemplary embodiment, the cam assembly 230 is generally configured as a cam lever moveable between a first, unlocked position, wherein the cap 252 is in a first wedged position relative to the nested second hollow cylinder 244/lower cylinder portion 240*b* (FIG. 6), and a second, locked position, wherein the cap 252 is in a second, wedged position relative to the nested second hollow cylinder 244/lower cylinder portion 240*b* (FIG. 7).

In the first wedged position, the first annular wedge 256 of the cap 252 is located between the bottom ends of the nested second hollow cylinder 244/lower cylinder portion 240*b* but exerts minimal to no radial expansion force on the second hollow cylinder 244. However, the first annular wedge 256 of the cap 252 is positioned to be pulled axially upwardly into further wedged engagement with the nested second hollow cylinder 244/lower cylinder portion 240*b*. In that regard, a suitable initial radial clearance may be defined between the nested bottom ends of the second hollow cylinder 244 and the lower cylinder portion 240*b* to facilitate axial movement of the cap 252 from the first wedged position into the second wedged position. In the depicted exemplary embodiment, the lower cylinder portion 240*b* may include a reduced diameter portion 259 at its bottom end that defines an initial radial separation or space between the nested bottom ends of the second hollow cylinder 244 and the lower cylinder portion 240*b*. When in the first wedged position, the cap 252 may be pulled axially upwardly into the second, wedged position to exert a radial expansion force on the second hollow cylinder 244.

The cam assembly 230 for selectively pulling the cap 252 up into the second, wedged position for radially expanding the second hollow cylinder 244 will now be described in detail. As noted above, the cam assembly 230 is generally configured as a cam lever moveable between a first, unlocked position (FIG. 6) and a second, locked position (FIG. 7).

Although any suitable cam assembly may be used, in the depicted exemplary embodiment, the cam assembly 230 includes a handle 270 extending from a cam head 274 that is pivotally secured to a cam pin 278 located inside the leg 204. The handle 270 extends from the cam head 274 through an opening 280 in the leg 204 such that it may be grasped by a user to rotate the cam head 274 about an axis of the cam pin 278 between the unlocked and locked positions.

The axis of the cam pin 278 is substantially transverse to a longitudinal center axis of the leg 204, and the handle 270 extends from the cam head 274 substantially transversely to the axis of the cam pin 278. Moreover, in the first, unlocked position, the handle 270 extends through the opening 280 substantially transversely to the longitudinal axis of the leg 204, and in the second, locked position, the handle 270 is in substantially parallel alignment with the longitudinal axis of the leg 204.

A grasping portion 272 of the handle 270 may substantially abut against the leg 204 in the locked position (with suitable clearance therebetween, such as through a standoff, not labeled) to stow the handle 270 against the leg 204 after the leg 204 is secured within the base 214. In that regard, the handle 270 may include a suitable bend, curvature, or contour between the grasping portion 272 and the cam head 274 to facilitate movement of the handle 270 between the unlocked and locked positions while connected to the cam head 274.

As the cam head 274 is moved by the handle 270 from the unlocked position into the locked position, it pulls upwardly on the cap 252, as noted above. In that regard, the cam head 274 is coupled to the cap 252 such that the cap 252 moves axially within the leg 204 as the cam head 274 is rotated between the unlocked and locked positions. In the depicted embodiment, the cap 252 is coupled to the cam head 274 through an anchor pin 276.

At its upper end, the anchor pin 276 is transversely and pivotally connected to the cam pin 278, and at its opposite, lower end, the anchor pin 276 is transversely coupled to the cap 252 (such as by threading or the like). In that regard, the anchor pin 276 extends through the axially aligned hollow interiors of the first and second hollow cylinders 240 and 244 along the length of the interference assembly 234. As the cam head 274 is rotated into the locked position, as shown in FIG. 7, it imposes an axial pulling force on the anchor pin 276 to move the cap 252 axially upwardly into the second, wedged position.

The cam head 274 pivots against a pivot plate or washer assembly 282 as it is moved between the unlocked and locked positions. The washer assembly 282 is positioned substantially transversely to the axis of the anchor pin 276 to provide a surface against which the cam force of the cam head 274 may be opposed. In the depicted embodiment, the washer assembly 282 is received within an upper open end of the upper cylinder portion 240*a*, and the anchor pin 276 passes through a central opening of the washer assembly 282.

The washer assembly 282 may rest atop a biasing member, such as compression spring 286 to urge the washer assembly 282 up into engagement with the cam head 274. The compression spring 286 is disposed within a bore 290 defined at the upper end of the upper cylinder portion 240*a*. The bore 290 includes an interior, bottom annular shoulder 294 to oppose the compression force of the compression spring 286.

The cam head 274 is configured to impose a downward cam force on the washer assembly 282 (against the force of the spring 286) when it is pivoted about the axis of the cam pin 278 into the locked position (see FIG. 7). In that regard, the cam pin 278 passes through the cam head 274 at an off-center location to define an eccentric portion 275 of the cam head 274. As the cam head 274 is pivoted about the axis of the cam pin 278 (through movement of the handle 270), the eccentric portion 275 moves down into engagement with the washer assembly 282 to apply downward pressure on the washer assembly 282.

The washer assembly 282 opposes the downward cam force of the cam head 274 through the biasing force of the spring 286. In that regard, as the eccentric portion 275 moves down into engagement with the washer assembly 282, the spring 286 opposes the downward cam force and causes the cam pin 278 to translate vertically away from the washer assembly 282. As the cam pin 278 moves vertically away from the washer assembly 282, it pulls upwardly on the anchor pin 276, which correspondingly pulls the cap 252 upwardly into the locked, second wedged position. After reaching the locked position, the opposing force of the spring 286 helps retain the eccentric portion 275 of the cam head 274 in engagement with the washer assembly 282 by pushing up on the washer assembly 282. With the eccentric portion 275 secured in its locked position against the washer assembly 282, the cap 252 is heled in its second, wedged position between the cylinders 240*b* and 244.

To move the cam assembly 230 back into the unlocked position, the pulling force on the handle 270 must overcome the biasing force of the spring 286. Specifically, when the pulling force on the handle 270 back down towards the unlocked position (see FIG. 6) overcomes the biasing force of the spring 286, the cam head 274 to may correspondingly pivot against the washer assembly 282 to move the eccentric portion 275 out of engagement with the washer assembly 282. When the eccentric portion 275 moves out of engagement with the washer assembly 282, the cam pin 278 and therefore the anchor pin 276 move axially downward, releasing the cap 252 from its second, wedged position between the cylinders 240*b* and 244.

As can be appreciated from the foregoing, as the handle 270 and cam head 274 pivot into the locked position, the cam head 274 draws the washer assembly 282 and the cap 252 towards each other. The clamping distance of the cam assembly 230, or the distance that the washer assembly 282 and cap 252 travel toward each other, is sufficient to move the first annular wedge 256 of the cap 252 into the second wedged position relative to the nested bottom ends of the second hollow cylinder 244 and the lower cylinder portion 240*b*. In this second wedged position, the cap 252 applies a radial expansion force on the second hollow cylinder 244, thereby lockingly securing the leg 204 within the leg receptacle 228.

The clamping distance of the cam assembly 230 can be adjusted as needed to accommodate mounting systems having a different height or configuration. Moreover, it can be appreciated that the spring 286 helps accommodate tolerances of the mounting system 210. For instance, the spring 286 may compress to allow the handle 270 and cam head 274 to be fully rotated into the locked position, which may not otherwise be possible due to tolerances in the base 214, interference assembly 234, cam assembly 230, etc.

As noted above, the second hollow cylinder 244 may have a high friction exterior surface to increase the locking interface between the second hollow cylinder 244 and the base 214. However, it can be appreciated that a high friction interface between the second hollow cylinder 244 and the base 214 is not desired when initially inserted the interference assembly 234 into the leg receptacle 228.

In that regard, a sufficient radial clearance is initially defined between the unexpanded second hollow cylinder 244 and the interior of the leg receptacle 228 such that the high friction exterior surface does not grip against the interior of the base 214. Accordingly, the second hollow cylinder 244 may be initially inserted into the leg receptacle 228 of the base 214 in its initial unexpanded (unlocked) state without having to overcome the friction force. Thereafter, when moved into the expanded (locked) position, the high friction exterior surface of the second hollow cylinder 244 grips against the interior surface of the leg receptacle 228 to further increase the locking interface between the interference assembly 234 and the leg receptacle.

However, it can further be appreciated that the interior surfaces of the interference assembly 234 need to be low friction to facilitate sliding movement relative to one another. For instance, the interior surface of the second hollow cylinder 244 and the exterior surface of the lower cylinder portion 240*b* of the first hollow cylinder 240 should be able to slide axially relative to one another during assembly of the interference assembly 234 and/or during radial expansion of the second hollow cylinder 244.

However, with a low friction interface defined between the second hollow cylinder 244 and the lower cylinder portion 240*b*, the second hollow cylinder 244 and the lower cylinder portion 240*b* may undesirably rotate relative to one another (about the center longitudinal axis of the interference assembly 234) during assembly and/or during use of the mounting system 210. Accordingly, the interference assembly 234 may include an anti-rotation mechanism configured to substantially prevent the second hollow cylinder 244 from rotating relative to the lower cylinder portion 240*b* (and vice versa).

Figure 5:
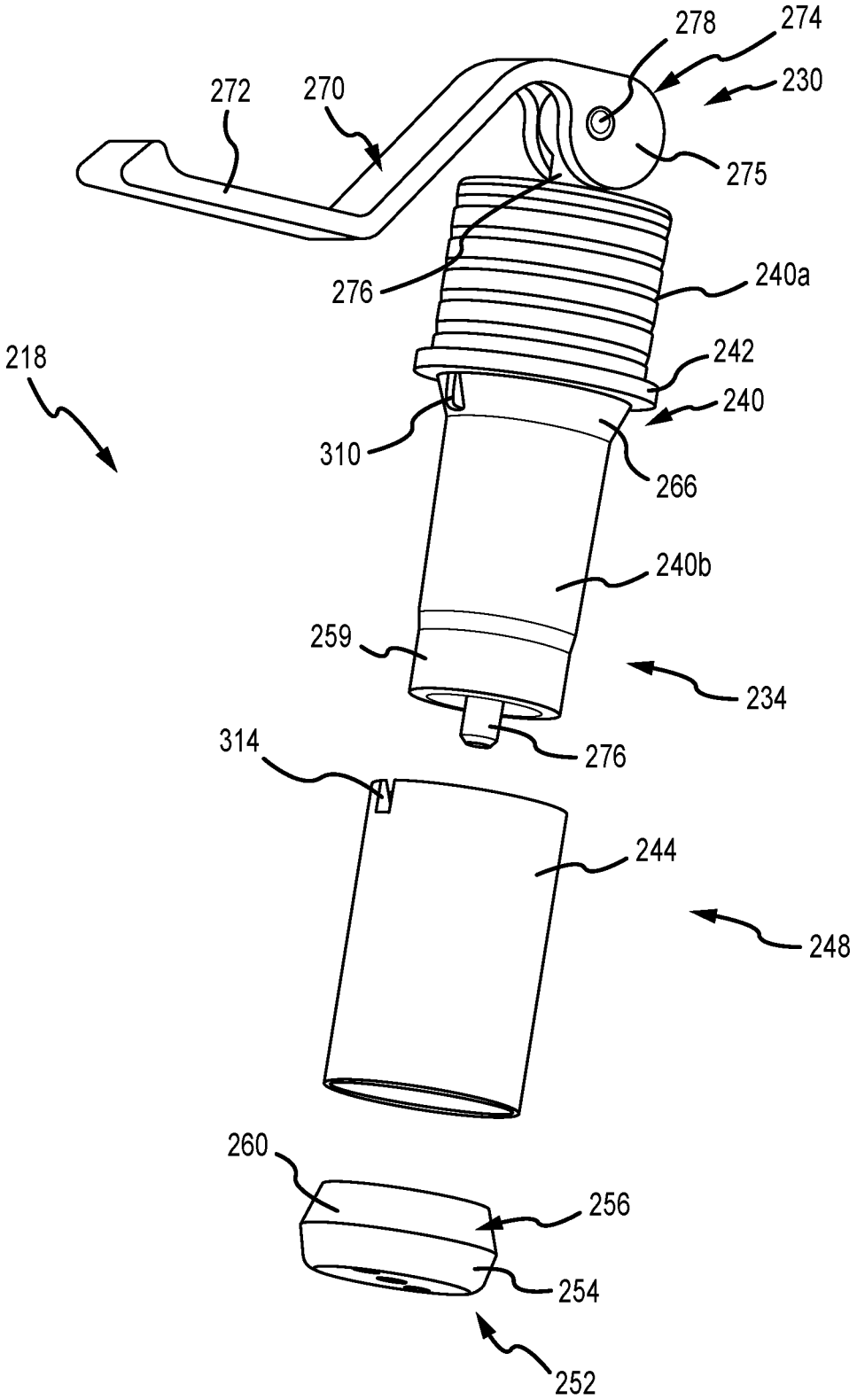
FIG. 5 a partial isometric exploded view of the a locking assembly of the mounting system of FIG. 2.

Referring to FIG. 5, in the depicted exemplary embodiment, the anti-rotation mechanism is defined by an axial protrusion 310 extending radially from the lower cylinder portion 240*b* that is axially receivable within a correspondingly shaped axial slot 314 extending along the second hollow cylinder 244. In particular, the axial protrusion 310 extends radially from the third annular wedge 266 of the lower cylinder portion 240*b*, and the axial slot 314 extends downwardly from the top edge of the second hollow cylinder 244. In this manner, when the lower cylinder portion 240*b* is nested within the second hollow cylinder 244 with the protrusion 310 and slot 314 axially aligned, the protrusion 310 is received within the slot 314. When the axial protrusion 310 is axially received within the slot 314, the protrusion 310 and slot 314 interfere to prevent the second hollow cylinder 244 and lower cylinder portion 240*b* from rotating relative to one another.

Referring to FIGS. 6 and 7, the method and operation of the mounting system 210 for selectively locking the leg 204 within the base 214 will now be described. As can be seen in FIG. 6, the locking assembly 218 is initially in an unlocked state with the handle 270 extending substantially transversely from the body 206 of the leg 204. When unlocked, the eccentric portion 275 of the cam head 274 is rotated out of engagement with the washer assembly 282. The cap 252 is in the first wedged position but exerts minimal to no radial expansion force on the second hollow cylinder 244.

In this unlocked state, the interference assembly 234 extending from the bottom of the leg 204 is axially inserted into leg receptacle 228 of the base 214. Once disposed within the leg receptacle 228, the handle 270 may be rotated upwardly into the locked position, rotating the eccentric portion 275 of the cam head 274 down into engagement with the washer assembly 282. The washer assembly 282 reacts the downward force of the cam head 274 (through the biasing force of the spring 286), and the cam pin 278 translates upwardly. As the cam pin 278 moves upwardly, it pulls axially upwardly on the anchor pin 276 and therefore the cap 252. The cap 252 is pulled up into the second wedged position where it imposes a radial expansion force on the second hollow cylinder 244 to secure the interference assembly 234 within the leg receptacle 228.

While the concepts of the present disclosure are susceptible to various modifications and alternative forms, specific embodiments thereof have been shown by way of example in the drawings and will be described herein in detail. It should be understood, however, that there is no intent to limit the concepts of the present disclosure to the particular forms disclosed, but on the contrary, the intention is to cover all modifications, equivalents, and alternatives consistent with the present disclosure and the appended claims.

References in the specification to "one embodiment," "an embodiment," "an illustrative embodiment," etc., indicate that the embodiment described may include a particular feature, structure, or characteristic, but every embodiment may or may not necessarily include that particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

Language such as "top", "bottom", "upper", "lower", "vertical", "horizontal", "lateral", in the present disclosure is meant to provide orientation for the reader with reference to the drawings and is not intended to be the required orientation of the components or to impart orientation limitations into the claims.

In the drawings, some structural or method features may be shown in specific arrangements and/or orderings. However, it should be appreciated that such specific arrangements and/or orderings may not be required. Rather, in some embodiments, such features may be arranged in a different manner and/or order than shown in the illustrative figures. Additionally, the inclusion of a structural or method feature in a particular figure is not meant to imply that such feature is required in all embodiments and, in some embodiments, it may not be included or may be combined with other features.

While illustrative embodiments have been illustrated and described, it will be appreciated that various changes can be made therein without departing from the spirit and scope of the disclosure.

The invention claimed is:

1. A mounting system for an antenna apparatus having a housing enclosing antenna components and a leg extending from the housing, the mounting system comprising:

a base securable to a surface and defining a leg receptacle configured to receive a bottom portion of the leg; and a locking assembly defined at the bottom portion of the leg and configured to be received by the leg receptacle and moveable between a first position, wherein the leg is removable from the base, and a second position, wherein the leg is lockingly secured within the base, the locking assembly including an interference assembly configured to be radially expanded in the second position to secure the leg within the base, wherein the locking assembly includes a cam assembly having a cam head and a handle, the cam head disposed within the leg and the handle external to the leg, and wherein the interference assembly further comprises:

a first hollow cylinder secured within the bottom portion of the leg;

a second hollow cylinder receivable within the base, the first hollow cylinder received within the second hollow cylinder; and a wedge assembly configured to impose a radial expansion force on the second hollow cylinder.

2. The mounting system of claim 1, wherein the wedge assembly includes a first annular wedge configured to be moved into wedged engagement with the first and second hollow cylinders.

3. The mounting system of claim 2, wherein the first annular wedge is moveable by the cam assembly between a first wedge position, wherein the first annular wedge exerts substantially no radial expansion force on the second hollow cylinder, and a second wedge position, wherein the first annular wedge exerts a radial expansion force on the second hollow cylinder.

4. The mounting system of claim 3, wherein the cam assembly pulls axially upwardly on an anchor pin connected to the first annular wedge when the cam head is moved from a first position into a second position.

5. The mounting system of claim 3, wherein the handle extends from the cam head, the cam head is pivotal against a biased washer assembly disposed within an upper end of the first hollow cylinder and moveable between first and second positions, wherein in the second position, the cam head pulls axially upwardly on an anchor pin connected to the first annular wedge.

6. The mounting system of claim 5, wherein the cam head includes an eccentric portion moveable into engagement with the washer assembly when the cam head is moved into the second position.

7. The mounting system of claim 2, wherein the wedge assembly includes a second annular wedge defined at a bottom end of the second hollow cylinder that mates with the first annular wedge as it is moved into wedged engagement with the first and second hollow cylinders.

8. The mounting system of claim 7, wherein the wedge assembly includes a third annular wedge defined at an upper end of the first hollow cylinder that is configured to mate with a fourth annular wedge defined at an upper end of the second hollow cylinder.

9. The mounting system of claim 1, wherein the first hollow cylinder includes an upper cylinder portion securable within the leg and a lower cylinder portion receivable within the second hollow cylinder.

10. The mounting system of claim 1, further comprising an anti-rotation mechanism configured to substantially prevent rotation of the first hollow cylinder relative to the second hollow cylinder.

11. The mounting system of claim 10, wherein the anti-rotation mechanism is defined by an axial protrusion extending from one of the first and second hollow cylinders that is receivable within an axial slot defined in the other of the first and second hollow cylinders.

12. The mounting system of claim 1, wherein the cam assembly pulls axially upwardly on a wedge to radially expand a portion of the interference assembly when the cam head is moved from a first position into a second position.

13. The mounting system of claim 1, wherein the cam head is pivotal against a biased washer assembly disposed within an upper end of the interference assembly and moveable between first and second positions, wherein in the second position, the cam head pulls axially upwardly on a wedge to radially expand a portion of the interference assembly.

14. The mounting system of claim 13, wherein the cam head includes an eccentric portion moveable into engagement with the washer assembly when the cam head is moved into the second position.

15. The mounting system of claim 1, wherein the wedge assembly is moveable into locking engagement between the first and second hollow cylinders.

16. An antenna apparatus, comprising:

a housing enclosing antenna components;

a leg extending from the housing;

a base securable to a surface and configured to receive a bottom portion of the leg; and a locking assembly defined at the bottom portion of the leg and moveable between a first position, wherein the leg is removable from the base, and a second position, wherein the leg is lockingly secured within the base, the locking assembly including an interference assembly configured to be radially expanded in the second position to secure the leg within the base, wherein the locking assembly includes a cam assembly having a cam head and a handle, the cam head disposed within the leg and the handle external to the leg, and wherein the interference assembly further comprises:

a first hollow cylinder secured within the bottom portion of the leg;

a second hollow cylinder receivable within the base, the first hollow cylinder received within the second hollow cylinder; and a wedge assembly configured to impose a radial expansion force on the second hollow cylinder.

* * * * *